US007148279B2

(12) United States Patent
Voorheis et al.

(10) Patent No.: US 7,148,279 B2
(45) Date of Patent: Dec. 12, 2006

(54) GOLF BALL COMPOSITIONS COMPRISING DYNAMICALLY VULCANIZED BLENDS OF HIGHLY NEUTRALIZED POLYMERS AND DIENE RUBBER

(75) Inventors: Peter R. Voorheis, New Bedford, MA (US); Michael J. Sullivan, Barrington, RI (US); Derek A. Ladd, Acushnet, MA (US); Murali Rajagopalan, South Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 234 days.

(21) Appl. No.: 10/882,130

(22) Filed: Jun. 30, 2004

(65) Prior Publication Data

US 2004/0242802 A1 Dec. 2, 2004

Related U.S. Application Data

(63) Continuation-in-part of application No. 10/360,745, filed on Feb. 6, 2003, now Pat. No. 6,894,098, and a continuation-in-part of application No. 10/208,580, filed on Jul. 30, 2002, now Pat. No. 6,991,563, which is a continuation-in-part of application No. 10/164,809, filed on Jun. 7, 2002, now Pat. No. 6,774,187, which is a continuation-in-part of application No. 09/833,667, filed on Apr. 13, 2001.

(51) Int. Cl.

| | |
|---|---|
| ***A63B 37/00*** | (2006.01) |
| ***A63B 37/06*** | (2006.01) |
| ***A63B 37/12*** | (2006.01) |
| ***C08L 9/00*** | (2006.01) |

(52) U.S. Cl. ..... 524/394; 524/322; 524/397; 524/398; 524/399; 524/400; 525/192; 525/193; 525/194; 525/195; 525/221; 473/372; 473/373; 473/385

(58) Field of Classification Search ..... None
See application file for complete search history.

(56) References Cited

U.S. PATENT DOCUMENTS

| | | | | |
|---|---|---|---|---|
| 4,661,554 | A | 4/1987 | Coran et al. | 524/504 |
| 5,155,157 | A | 10/1992 | Statz et al. | 524/423 |
| 5,306,760 | A | 4/1994 | Sullivan | 524/400 |
| 5,312,857 | A | 5/1994 | Sullivan | 524/400 |
| 5,407,998 | A | 4/1995 | Horiuchi et al. | 525/133 |
| 5,643,390 | A | 7/1997 | Don et al. | 156/307.1 |
| 5,688,191 | A | 11/1997 | Cavallaro et al. | 473/373 |
| 5,789,475 | A | 8/1998 | Chen | 524/300 |
| 5,803,831 | A | 9/1998 | Sullivan et al. | 473/374 |
| 5,820,488 | A * | 10/1998 | Sullivan et al. | 473/374 |
| 5,833,552 | A | 11/1998 | Hamada et al. | 473/359 |
| 5,902,855 | A | 5/1999 | Sullivan | 525/221 |
| 5,967,907 | A | 10/1999 | Takemura et al. | 473/373 |
| 5,973,046 | A | 10/1999 | Chen et al. | 524/300 |
| 6,096,830 | A * | 8/2000 | Takemura et al. | 525/192 |
| 6,100,321 | A | 8/2000 | Chen | 524/400 |
| 6,290,613 | B1 | 9/2001 | Irii et al. | 473/377 |
| 6,329,458 | B1 | 12/2001 | Takesue et al. | 524/400 |
| 6,344,525 | B1 | 2/2002 | Lee et al. | 525/384 |
| 6,350,815 | B1 | 2/2002 | Sullivan et al. | 525/196 |
| 6,423,760 | B1 | 7/2002 | Qiao et al. | 522/150 |
| 6,494,795 | B1 | 12/2002 | Sullivan | 473/372 |
| 6,498,213 | B1 | 12/2002 | Jeong et al. | 525/191 |
| 6,635,716 | B1 | 10/2003 | Voorheis et al. | 525/261 |
| 6,695,718 | B1 | 2/2004 | Nesbitt | 473/374 |
| 6,777,472 | B1 * | 8/2004 | Statz et al. | 524/322 |
| 2001/0018375 | A1 | 8/2001 | Hayashi et al. | 473/371 |
| 2001/0019971 | A1 | 9/2001 | Hayashi et al. | 473/371 |
| 2002/0013421 | A1 | 1/2002 | Takesue et al. | 524/418 |
| 2002/0037968 | A1 | 3/2002 | Chen | 525/194 |
| 2002/0055400 | A1 | 5/2002 | Higuchi et al. | 473/374 |
| 2002/0061793 | A1 | 5/2002 | Higuchi et al. | 473/371 |
| 2002/0086745 | A1 * | 7/2002 | Rajagopalan | 473/371 |
| 2002/0091188 | A1 | 7/2002 | Statz et al. | 524/400 |
| 2002/0099120 | A1 | 7/2002 | Takesue et al. | 524/394 |
| 2002/0111407 | A1 | 8/2002 | Takesue et al. | 524/322 |
| 2002/0177492 | A1 | 11/2002 | Watanabe et al. | 473/371 |
| 2002/0187857 | A1 | 12/2002 | Kuntimaddi et al. | 473/373 |
| 2003/0013549 | A1 | 1/2003 | Rajagopalan et al. | 473/354 |
| 2003/0022733 | A1 | 1/2003 | Sullivan et al. | 473/372 |
| 2003/0158352 | A1 | 8/2003 | Rajagopalan et al. | 525/452 |
| 2003/0207998 | A1 | 11/2003 | Voorheis et al. | 525/261 |
| 2003/0229183 | A1 | 12/2003 | Voorheis et al. | 525/232 |

FOREIGN PATENT DOCUMENTS

| | | |
|---|---|---|
| WO | WO 00/23519 A1 | 4/2000 |
| WO | WO 01/29129 A1 | 4/2001 |

* cited by examiner

*Primary Examiner*—David J. Buttner
(74) *Attorney, Agent, or Firm*—William B. Lacy

(57) ABSTRACT

A golf ball a core and a cover, wherein at least one of the core or the cover includes a blend of a highly neutralized ionomer formed from a reaction between an ionomer having acid groups, a suitable cation source, and a salt of an organic acid, the cation source being present in an amount sufficient to neutralized the acid by 80% or greater; and a crosslinked or vulcanized diene rubber.

27 Claims, No Drawings

GOLF BALL COMPOSITIONS COMPRISING DYNAMICALLY VULCANIZED BLENDS OF HIGHLY NEUTRALIZED POLYMERS AND DIENE RUBBER

CROSS-REFERENCE TO RELATED APPLICATIONS

The present application is a continuation-in-part of U.S. patent application Ser. No. 10/360,745, filed Feb. 6, 2003, now U.S. Pat. No. 6,894,098, a continuation-in-part of U.S. patent application Ser. No. 10/164,809, filed Jun. 7, 2002, now U.S. Pat. No. 6,774,187, a continuation-in-part of co-pending U.S. patent application Ser. No. 09/833,667, filed Apr. 13, 2001, and a continuation-in-part of U.S. patent application Ser. No. 10/208,580, filed Jul. 30, 2002, now U.S. Pat. No. 6,991,563. These parent applications are incorporated herein by reference in their entireties.

FIELD OF THE INVENTION

The present invention is directed to golf balls having at least one layer comprising a dynamically vulcanized alloy (DVA) of a highly neutralized polymer (HNP) and a diene rubber (DR), or optionally a blend wherein the composition comprises the HNP and the DR that may form an interpenetrating polymer network (IPN).

BACKGROUND OF THE INVENTION

Conventional golf balls can be divided into two general classes: solid and wound. Solid golf balls include one-piece, two-piece (i.e., solid core and a cover), and multi-layer (i.e., solid core of one or more layers and/or a cover of one or more layers) golf balls. Wound golf balls typically include a solid, hollow, or fluid-filled center, surrounded by a tensioned elastomeric material, and a cover. It is also possible to surround a hollow or fluid-filled center with a plurality of solid layers. Solid balls have traditionally been considered longer and more durable than wound balls, but many traditional solid constructions lack the "feel" provided by the wound construction.

By altering ball construction and composition of solid balls, manufacturers recently have been able to vary a wide range of playing characteristics, such as compression, velocity, "feel," and spin, optimizing each or all be optimized for various playing abilities. In particular, a variety of core and cover layer(s) constructions, such as multi-layer balls having dual cover layers and/or dual core layers, have been investigated and now allow many non-wound balls to exhibit characteristics previously not maintainable in a solid-construction golf ball. These golf ball layers are typically constructed with a number of polymeric compositions and blends, including polybutadiene rubber, polyurethanes, polyamides, and ethylene-based ionomers.

Highly neutralized polymers of ionomers, and in particular ethylene-based $\alpha,\beta$-ethylenically unsaturated carboxylic acid copolymers or a melt processible ionomer thereof, are a preferred polymer for many golf ball layers. However, one problem encountered with the use of ionomers as stiff layers is the unprocessability of the material as the percent of neutralization of the acid group increases. Ionomers are stiffened by increasing the amount of neutralization by a metal cation or a salt thereof. Once the percent of neutralization is greater than about 60% (depending on metal cation selected), the melt flow of the ionomer becomes too low and the ease of processability decreases or disappears altogether.

Diene rubber or some form thereof, which provides the primary source of resiliency for the golf ball, has been used as the material for most conventional solid cores. The core of solid golf balls is the "engine" of the ball, providing the velocity required for good distance. Too hard a core, however, can result in a golf ball that provides poor feel. Compositions of this type are constantly being altered in an effort to provide a higher coefficient of restitution (COR) while at the same time resulting in a lower compression which, in turn, can lower the golf ball spin rate, provide better "feel," or both.

A dynamically vulcanized alloy is a representation of a blend of two polymeric components such that one polymeric component is vulcanized or crosslinked dynamically in the presence of another polymeric component that is not covalently crosslinked. Dynamically vulcanization is a method of making new polymeric materials from existing polymeric components. DVA also implies that an intimate mixture of both blend components is formed as a result of crosslinking while the components are mixed. In this invention, an HNP and a DR may be blended such that the DR is dynamically vulcanized to form an alloy in the presence of the HNP that remains essentially not covalently crosslinked. DVA of two polymeric components will exhibit properties that are in between those of the pure polymers.

On the other hand, an interpenetrating polymer network is a representation of heterogeneous materials in which the polymeric components are cross-linked within the kinds. As a result, the IPN will not result in some cases in a phase-separated situation. Therefore, an IPN of different polymers will also exhibit properties that are at least in between those of the pure polymers, and sometimes the new material shows a synergistic increase of the properties of the polymers. In a thermoplastic IPN, components are mixed together but not chemically crosslinked.

Perimeter weighted (PW) golf balls provide better control of spin rate, which is an important feature for both skilled and recreational golfers. High spin rate allows the more skilled players to produce and control back spin to stop the ball on the green and side spin to draw or fade the ball. In contrast, recreational players prefer a low spin golf ball which tends not to drift off-line erratically if the shot is not hit squarely off the club face. The control of the spin rate of golf balls can be achieved by reallocating the density or specific gravity of the various layers or mantles in the ball. When the weight from the outer portions of the golf ball is redistributed to the center, the moment of inertia decreases and the spin rate increases. When the weight from the inner portion of the golf ball is redistributed outward, as in the case of a PW golf ball, the moment of inertia increases and the spin rate decreases.

However, the art does not provide golf ball compositions comprising a blend of HNP and DR that are in IPN to make highly resilient, durable and tailorable golf ball components that show a wide range of hardness and modulus properties as well as PW characteristics.

SUMMARY OF THE INVENTION

The present invention is directed to a golf ball a core and a cover, wherein at least one of the core or the cover comprises a blend of a highly neutralized ionomer formed from a reaction between an ionomer having acid groups, a suitable cation source, and a salt of an organic acid, the cation source being present in an amount sufficient to neutralized the acid by 80% or greater; and a crosslinked or vulcanized diene rubber.

The highly neutralized ionomer and the diene rubber may form a dynamically vulcanized alloy or an interpenetrating polymer network. Additionally, at least one of the highly neutralized ionomer or diene rubber may be in a continuous phase in the interpenetrating polymer network. Alternatively, the highly neutralized ionomer and the diene rubber are in co-continuous phases in the interpenetrating polymer network.

The core or the cover can also include ionomeric copolymers, ionomeric terpolymers, ionomer precursors, thermoplastics, thermoplastic elastomers, grafted metallocene-catalyzed polymers, non-grafted metallocene-catalyzed polymers, single-site polymers, high-crystalline acid polymers and ionomers thereof, or cationic ionomers. Preferably, the organic acid is selected from the group consisting of aliphatic organic acids, aromatic organic acids, saturated mono-, di or multi-functional organic acids, unsaturated mono-, di- or multi-functional organic acids, and multi-unsaturated mono-functional organic acids.

The cation source includes barium, lithium, sodium, zinc, bismuth, chromium, cobalt, copper, potassium, strontium, titanium, tungsten, magnesium, cesium, iron, nickel, silver, aluminum, tin, or calcium. Preferably, the highly neutralized ionomer is neutralized by 90% or greater, more preferably 100%.

The diene rubber includes natural rubber, balata, gutta-percha, acrylate-butadiene rubber, bromo-isobutylene-isoprene rubber, butadiene rubber, chloro-isoprene-isoprene rubber, chloroprene rubber, ethylene-propylene-diene rubber, ethylene-propylene rubber, guayule rubber, hydrogenated acrylonitrile-butadiene rubber, isobutylene-isoprene rubber, polyisobutylene rubber, synthetic isoprene rubber, acrylonitrile-butadiene rubber, acrylonitrile-chloroprene rubber, acrylonitrile-isoprene rubber, vinylpyridine-butadiene rubber, vinylpyridine-styrene-butadiene rubber, styrene-butadiene rubber, styrene-chloroprene rubber, styrene-isoprene rubber, carboxylic-styrene-butadiene rubber, or carboxylic-acrylonitrile-butadiene rubber.

The diene rubber may also be a blend including a first polybutadiene formed with a cobalt or nickel catalyst having a first Mooney viscosity between 40 to 150; and a second polybutadiene formed with a lanthanide series catalyst having a second Mooney viscosity between 30 to 100, wherein the first Mooney viscosity is greater than the second Mooney viscosity, and wherein the blend has a greater weight percentage of the first polybutadiene than that of the second polybutadiene. Preferably, the diene rubber is selected from the group consisting of regrind of diene rubber, sulfur-cured diene rubber, and peroxide-cured diene rubber.

The sulfur-cured diene rubber is typically a product of treating a diene rubber with a vulcanizing agent including sulfur; insoluble sulfur; 4-morpholinyl-2-benzothiazole disulfide; dipentamethylenethiuram hexasulfide; thiuram disulfides; N-oxydiethylene 2-benzothiazole sulfonamide; N,N-diorthotolyguanidine; bismuth dimethyldithiocarbamate; N-cyclohexyl 2-benzothiazole sulfonamide; or N,N-diphenylguanidine.

The peroxide-cured diene rubber generally is a product of treating a diene rubber with an initiating agent including dicumyl peroxide; 2,5-dimethyl-2,5-di(t-butylperoxy) hexane; 2,5-dimethyl-2,5-di(t-butylperoxy)hexyne; 2,5-dimethyl-2,5-di(benzoylperoxy)hexane; 2,2'-bis(t-butylperoxy)-di-iso-propylbenzene; 1,1-bis(t-butylperoxy)-3,3,5-trimethyl cyclohexane; n-butyl 4,4-bis(t-butyl-peroxy) valerate; t-butyl perbenzoate; benzoyl peroxide; n-butyl 4,4'-bis(butylperoxy)valerate; di-t-butyl peroxide; or 2,5-di-(t-butylperoxy)-2,5 dimethyl hexane.

Regarding ball construction, the core typically has a diameter from 1.25 inches to 1.65 inches and/or a hardness of 50 Shore A to 90 Shore D. The core may include an inner core layer having a diameter of 0.25 inches to 1.6 inches and an outer core layer having a thickness of 0.1 inches or greater. The golf ball further may further include an intermediate layer having a thickness of 0.002 inches to 0.1 inches, more preferably, 0.01 inches to 0.045 inches. Also, the intermediate layer may be a moisture barrier layer. Preferably, the moisture vapor transmission rate of the intermediate layer is less than the moisture vapor transmission rate of the cover layer. The intermediate layer should have a hardness of 30 Shore D or greater.

The present invention is also directed to a golf ball comprising a core, a cover, and a thin dense layer disposed between the core and the cover, the thin dense layer having a specific gravity of greater than 1.2 and being located outside of a centroid radius of the ball, wherein at least one of the core, the thin dense layer, or the cover comprises a blend of a highly neutralized ionomer formed from a reaction between an ionomer having acid groups, a suitable cation source, and a salt of an organic acid, the cation source being present in an amount sufficient to neutralized the acid by 80% or greater; and a diene rubber. More preferably, the highly neutralized ionomer is neutralized by at least 90%, most preferably, 100%.

The diene rubber includes natural rubber, balata, gutta-percha, acrylate-butadiene rubber, bromo-isobutylene-isoprene rubber, butadiene rubber, chloro-isoprene-isoprene rubber, chloroprene rubber, ethylene-propylene-diene rubber, ethylene-propylene rubber, guayule rubber, hydrogenated acrylonitrile-butadiene rubber, isobutylene-isoprene rubber, polyisobutylene rubber, synthetic isoprene rubber, acrylonitrile-butadiene rubber, acrylonitrile-chloroprene rubber, acrylonitrile-isoprene rubber, vinylpyridine-butadiene rubber, vinylpyridine-styrene-butadiene rubber, styrene-butadiene rubber, styrene-chloroprene rubber, styrene-isoprene rubber, carboxylic-styrene-butadiene rubber, or carboxylic-acrylonitrile-butadiene rubber.

The diene rubber may also be a blend comprising a first polybutadiene formed with a cobalt or nickel catalyst having a first Mooney viscosity between 40 to 150; and a second polybutadiene formed with a lanthanide series catalyst having a second Mooney viscosity between 30 to 100, wherein the first Mooney viscosity is greater than the second Mooney viscosity, and wherein the blend has a greater weight percentage of the first polybutadiene than that of the second polybutadiene. Preferably, the diene rubber is selected from the group consisting of regrind of diene rubber, sulfur-cured diene rubber, and peroxide-cured diene rubber.

The sulfur-cured diene rubber is a product of treating a diene rubber with a vulcanizing agent including sulfur; insoluble sulfur; 4-morpholinyl-2-benzothiazole disulfide; dipentamethylenethiuram hexasulfide; thiuram disulfides; N-oxydiethylene 2-benzothiazole sulfonamide; N,N-di-orthotolyguanidine; bismuth dimethyldithiocarbamate; N-cyclohexyl 2-benzothiazole sulfonamide; or N,N-diphenylguanidine.

The peroxide-cured diene rubber is a product of treating a diene rubber with an initiating agent including dicumyl peroxide; 2,5-dimethyl-2,5-di(t-butylperoxy) hexane; 2,5-dimethyl-2,5-di(t-butylperoxy)hexyne; 2,5-dimethyl-2,5-di (benzoylperoxy)hexane; 2,2'-bis(t-butylperoxy)-di-iso-propylbenzene; 1,1-bis(t-butylperoxy)-3,3,5-trimethyl cyclohexane; n-butyl 4,4-bis(t-butyl-peroxy)valerate; t-butyl perbenzoate; benzoyl peroxide; n-butyl 4,4'-bis(butylperoxy) valerate; di-t-butyl peroxide; or 2,5-di-(t-butylperoxy)-2,5 dimethyl hexane. The highly neutralized ionomer and the diene rubber can form a dynamically vulcanized alloy or an interpenetrating polymer network.

The present invention is additionally directed to a one-piece golf ball comprising a blend of a highly neutralized ionomer formed from a reaction between an ionomer having acid groups, a suitable cation source, and a salt of an organic acid, the cation source being present in an amount sufficient to neutralized the acid by 80% or greater; and a crosslinked or vulcanized diene rubber.

DETAILED DESCRIPTION OF THE INVENTION

The present invention is directed to golf balls having at least one layer comprising a blend of a highly neutralized polymer with a diene rubber such that the HNP and the DR form a dynamically vulcanized alloy, or optionally an interpenetrating polymer network.

The present invention is further directed to perimeter weighted golf balls comprising a core, a thin dense layer, and a cover, wherein at least one of the core, the thin dense layer and the cover further comprises a blend of a HNP with a DR. In one embodiment, the HNP and the DR form a DVA or optionally an IPN.

The present invention is additionally directed to compositions for sports equipment comprising a blend of HNP and with a DR, wherein the HNP and the DR form a DVA, or optionally an IPN. The sports equipment includes other sport balls, golf club inserts, sport shoes and cleats.

HNP's are ionomers having acid groups that are neutralized by an organic acid or a salt thereof, the organic acid or salt thereof being present in an amount sufficient to neutralize the HNP's by at least about 80%. In another embodiment, the HNP's may be neutralized by about 90%. In a different embodiment, the HNP's may be neutralized by about 100%. A number of partially or fully neutralized HNP suitable for use in this invention are described in WO 00/23519, WO 01/29129. These HNP's can be of thermosetting or thermoplastic.

Furthermore, these HNP's comprises ionomeric copolymers, ionomeric terpolymers, ionomer precursors, thermoplastics, thermoplastic elastomers, grafted metallocene-catalyzed polymers, non-grafted metallocene-catalyzed polymers, single-site polymers, highly crystalline acid polymers and ionomers thereof, cationic ionomers and mixtures thereof.

Suitable HNP thermoplastic ionomer resins typically comprise about 1 to 85% by weight of the unsaturated mono- or di-carboxylic acid and/or ester thereof. More particularly, low modulus ionomers, such as acid-containing ethylene copolymer ionomers, include E/X/Y copolymers where E is ethylene, X is acrylic or methacrylic acid present in 5–35 (preferably 10–35, most preferably 15–35) weight percent of the polymer, and Y is a softening co-monomer such as an alkyl acrylate or an alkyl methacrylate present in 0–50 (preferably 0–45, most preferably 0–35) weight percent of the polymer, wherein the acid moiety is neutralized 1–100% (preferably at least 40%, most preferably at least about 60%) to form an ionomer comprising a cation such as lithium, sodium, potassium, magnesium, calcium, barium, lead, tin, zinc or aluminum, or a combination of such cations. In another embodiment, lithium, sodium, magnesium and zinc are the preferred cations in these HNP's.

Examples of HNP's that are suitable for this invention are specific acid-containing ethylene copolymers, including ethylene/acrylic acid, ethylene/methacrylic acid, ethylene/acrylic acid/n-butyl acrylate, ethylene/methacrylic acid/n-butyl acrylate, ethylene/methacrylic acid/methyl acrylate, ethylene/methacrylic acid/methyl acrylate, ethylene/methacrylic acid/methyl methacrylate, and ethylene/acrylic acid/n-butyl methacrylate. Preferred acid-containing ethylene copolymers include ethylene/methacrylic acid, ethylene/acrylic acid, ethylene/methacrylic acid/n-butyl acrylate, ethylene/acrylic acid/n-butyl acrylate, ethylene/methacrylic acid/methyl acrylate and ethylene/acrylic acid/methyl acrylate copolymers. The most preferred acid-containing ethylene copolymers are ethylene/methacrylic acid, ethylene/acrylic acid, ethylene/(meth)acrylic acid/n-butyl acrylate, ethylene/(meth)acrylic acid/ethyl acrylate, and ethylene/(meth)acrylic acid/methyl acrylate copolymers.

For another embodiment of this invention, the HNP's may be further blended with ionomer resins include SURLYN® and IOTEK®, which are commercially available from DuPont and Exxon, respectively. Likewise, other conventional non-ionic polymers materials such as balata, elastomer and polyethylene may also be used.

U.S. patent application Publication Nos. 2003/0114565, and 2003/0050373, which are incorporated by reference herein in their entireties, discuss soft and high resilient ionomers, which are preferably made from neutralizing the acid copolymer(s) of at least one E/X/Y copolymer, where E is ethylene, X is the $\alpha,\beta$-ethylenically unsaturated carboxylic acid, and Y is a softening co-monomer. In these applications for soft and high resilient ionomers, X is preferably present in 2–30 (preferably 4–20, most preferably 5–15) wt. % of the polymer, and Y is preferably present in 17–40 (preferably 20–40, and more preferably 24–35) wt. % of the polymer.

In a particular embodiment of this invention, the melt index (MI) of the base resin is at least 20, or preferably at least 40, more preferably at least 75 and most preferably at least 150. Particular soft, resilient ionomers included in this invention are partially neutralized ethylene/(meth)acrylic acid/butyl (meth)acrylate copolymers having an MI and level of neutralization that results in a melt processible polymer that has useful physical properties. The copolymers are at least partially neutralized. Preferably at least 40, or, more preferably at least 55, even more preferably about 70, and most preferably about 80 of the acid moiety of the acid copolymer is neutralized by one or more alkali metal, transition metal, or alkaline earth metal cations. Cations useful in making the ionomers of this invention comprise lithium, sodium, potassium, magnesium, calcium, barium, or zinc, or a combination of such cations.

The invention also relates to a "modified" soft, resilient thermoplastic ionomer that comprises a melt blend of (a) the acid copolymers or the melt processible ionomers made therefrom as described above and (b) one or more organic acid(s) or salt(s) thereof, wherein greater than 80%, preferably greater than 90% of all the acid of (a) and of (b) is neutralized. Preferably, 100% of all the acid of (a) and (b) is neutralized by a cation source. Preferably, an amount of cation source in excess of the amount required to neutralize 100% of the acid in (a) and (b) is used to neutralize the acid in (a) and (b). Blends with fatty acids or fatty acid salts are preferred.

The organic acids or salts thereof are added in an amount sufficient to enhance the resilience of the copolymer. Preferably, the organic acids or salts thereof are added in an amount sufficient to substantially remove remaining ethylene crystallinity of the copolymer.

Preferably, the organic acids or salts are added in an amount of at least about 5% (weight basis) of the total amount of copolymer and organic acid(s). More preferably, the organic acids or salts thereof are added in an amount of at least about 15%, even more preferably at least about 20%. Preferably, the organic acid(s) are added in an amount up to about 50% (weight basis) based on the total amount of copolymer and organic acid. More preferably, the organic acids or salts thereof are added in an amount of up to about 40%, more preferably, up to about 35%. The non-volatile, non-migratory organic acids preferably are one or more aliphatic, mono-, di- or multi-functional organic acids or salts thereof as described below, particularly one or more aliphatic, mono-, di- or multi-functional, saturated or unsaturated organic acids having less than 36 carbon atoms or salts of the organic acids, preferably stearic acid or oleic acid. Fatty acids or fatty acid salts are most preferred.

Processes for fatty acid (salt) modifications are known in the art. Particularly, the modified highly-neutralized soft, resilient acid copolymer ionomers of this invention can be produced by:

(a) melt-blending (1) ethylene, α,β-ethylenically unsaturated $C_{3-8}$ carboxylic acid copolymer(s) or melt-processible ionomer(s) thereof that have their crystallinity disrupted by addition of a softening monomer or other means with (2) sufficient non-volatile, non-migratory organic acids or salts thereof to substantially enhance the resilience and to disrupt (preferably remove) the remaining ethylene crystallinity, and then concurrently or subsequently;

(b) adding a sufficient amount of a cation source to increase the level of neutralization of all the acid moieties (including those in the acid copolymer and in the organic acid if the non-volatile, non-migratory organic acid is an organic acid) to the desired level.

With respect to the relative amounts of X and Y, the weight ratio of X to Y in the E/X/Y copolymer is at least about 1:20. Preferably, the weight ratio of X to Y is at least about 1:15, more preferably, at least about 1:10. Furthermore, the weight ratio of X to Y is up to about 1:1.67, more preferably up to about 1:2. Most preferably, the weight ratio of X to Y in the composition is up to about 1:2.2.

The acid copolymers used in the present invention to make the ionomers are preferably "direct" acid copolymers (containing high levels of softening monomers). As noted above, the copolymers are at least partially neutralized, preferably at least about 40% of X in the composition is neutralized. More preferably, at least about 55% of X is neutralized. Even more preferably, at least about 70, and most preferably, at least about 80% of X is neutralized. In the event that the copolymer is highly neutralized (e.g., to at least 45%, preferably 50%, 55%, 70%, or 80%, of acid moiety), the MI of the acid copolymer should be sufficiently high so that the resulting neutralized resin has a measurable MI in accord with ASTM D-1238, condition E, at 190° C., using a 2160 gram weight. Preferably, this resulting MI, in units of grams per 10-minutes will be at least 0.1, preferably at least 0.5, and more preferably 1.0 or greater. Preferably, for highly neutralized acid copolymer, the MI of the acid copolymer base resin is at least 20, or at least 40, at least 75, and more preferably at least 150.

The acid copolymers preferably comprise alpha olefin, particularly ethylene, $C_{3-8}$ α,β-ethylenically unsaturated carboxylic acid, particularly acrylic and methacrylic acid, and softening monomers, selected from alkyl acrylate, and alkyl methacrylate, wherein the alkyl groups have from 1–8 carbon atoms, copolymers. By "softening," it is meant that the crystallinity is disrupted (the polymer is made less crystalline). While the alpha olefin can be a $C_2$–$C_4$ alpha olefin, ethylene is most preferred for use in the present invention. Accordingly, it is described and illustrated herein in terms of ethylene as the alpha olefin.

The organic acids employed are aliphatic, mono-, di- or multi-functional (saturated, unsaturated, or multi-unsaturated) organic acids, particularly those having fewer than 36 carbon atoms. Also salts of these organic acids may be employed. Fatty acids or fatty acid salts are preferred. The salts may be any of a wide variety, particularly including the barium, lithium, sodium, zinc, bismuth, potassium, strontium, magnesium or calcium salts of the organic acids. Particular organic acids useful in the present invention include caproic acid, caprylic acid, capric acid, lauric acid, stearic acid, behenic acid, erucic acid, oleic acid, and linoleic acid.

The optional filler component is chosen to impart additional density to blends of the previously described components, the selection being dependent upon the different parts (e.g., cover, mantle, core, center, intermediate layers in a multilayered core or ball) and the type of golf ball desired (e.g., one-piece, two-piece, three-piece or multiple-piece ball), as will be more fully detailed below.

Generally, the filler will be inorganic having a density greater than about 3 g/cc, preferably greater than 5 g/cc, and will be present in amounts between 0 to about 60 wt. % based on the total weight of the composition. Examples of useful fillers include zinc oxide, barium sulfate, lead silicate and tungsten carbide, as well as the other well-known fillers used in golf balls. It is preferred that the filler materials be non-reactive or almost non-reactive and not stiffen or raise the compression nor reduce the coefficient of restitution significantly. Alternatively, or in addition to the above fillers, specific gravity reducing fillers such as glass, ceramic or polymeric hollow spheres may also be added.

Additional optional additives useful in the practice of the subject invention include acid copolymer wax (e.g., Allied wax AC 143 believed to be an ethylene/16–18% acrylic acid copolymer with a number average molecular weight of 2,040), which assist in preventing reaction between the filler materials (e.g., ZnO) and the acid moiety in the ethylene copolymer. Other optional additives include $TiO_2$, which is used as a whitening agent, optical brighteners, surfactants, processing aids, etc.

The HNP's may be blended with conventional ionomeric copolymers (di-, ter-, etc.), using well-known techniques, to manipulate product properties as desired. The blends would still exhibit lower hardness and higher resilience when compared with blends based on conventional ionomers.

Also, the inventive blends may be further blended with non-ionic thermoplastic resins to manipulate product properties. The non-ionic thermoplastic resins would, by way of non-limiting illustrative examples, include thermoplastic elastomers, such as polyurethane, poly-ether-ester, polyamide-ether, polyether-urea, PEBAX® (a family of block copolymers based on polyether-block-amide, commercially supplied by Atochem), styrene-butadiene-styrene (SBS) block copolymers, styrene(ethylene-butylene)-styrene block copolymers, etc., poly amide (oligomeric and polymeric), polyesters, polyolefins including PE, PP, E/P copolymers, etc., ethylene copolymers with various comonomers, such as vinyl acetate, (meth)acrylates, (meth)acrylic acid, epoxy-functionalized monomer, carbon dioxide, etc., functionalized polymers with maleic anhydride grafting, epoxidization etc., elastomers, such as EPDM, metallocene catalyzed PE and copolymer, ground up powders of the thermoset elastomers, etc.

Such thermoplastic blends comprise about 1% to about 99% by weight of a first thermoplastic and about 99% to about 1% by weight of a second thermoplastic.

Additionally, U.S. patent application Publication No. 2003/0130434, and U.S. Pat. No. 6,653,382, both of which are incorporated herein in their entirety, discuss compositions having high coefficient of restitution (COR) when formed into solid spheres. COR is an important measurement of the collision between the ball and a large mass. One conventional technique for measuring COR uses a golf ball or golf ball subassembly, air cannon, and a stationary vertical steel plate. The steel plate provides an impact surface weighing about 100 pounds or about 45 kg. A pair of ballistic light screens, which measure ball velocity, are spaced apart and located between the air cannon and the steel plate. The ball is fired from the air cannon toward the steel plate over a range of test velocities from 50 ft/s to 180 ft/s. Unless noted otherwise, all COR data presented in this application are measured using a speed of 125 ft/s. As the ball travels toward the steel plate, it activates each light screen so that the time at each light screen is measured. This provides an incoming time period proportional to the ball's incoming velocity. The ball impacts the steel plate and rebounds though the light screens, which again measure the time period required to transit between the light screens. This provides an outgoing transit time period proportional to the ball's outgoing velocity. The COR can be calculated by the ratio of the outgoing transit time period to the incoming transit time period.

Another method that measures COR uses a substantially fixed titanium disk. The titanium disk intending to simulate a golf club is circular, and has a diameter of about 4 inches, and has a mass of about 200 g. The impact face of the titanium disk may also be flexible and has its own coefficient of restitution, as discussed further below. The disk is mounted on an X-Y-Z table so that its position can be adjusted relative to the launching device prior to testing. A pair of ballistic light screens are spaced apart and located between the launching device and the titanium disk. The ball is fired from the launching device toward the titanium disk at a predetermined test velocity. As the ball travels toward the titanium disk, it activates each light screen so that the time period to transit between the light screens is measured. This provides an incoming transit time period proportional to the ball's incoming velocity. The ball impacts the titanium disk, and rebounds through the light screens which measure the time period to transit between the light screens. This provides an outgoing transit time period proportional to the ball's outgoing velocity. The COR can be calculated by the ratio of the outgoing time difference to the incoming time difference.

The composition comprising HNP of this invention comprises a polymer which, when formed into a sphere that is 1.50 to 1.54 inches in diameter, has COR greater than 0.750, preferably greater than 0.800, and most preferably from 0.807 to 0.837 using a steel plate.

The thermoplastic composition of this invention preferably comprises (a) aliphatic, mono-, di- or multi-functional organic acid(s) having fewer than 36 carbon atoms; and (b) ethylene, $C_3$ to C8 α,β-ethylenically unsaturated carboxylic acid copolymer(s) and ionomer(s) thereof, wherein greater than 90%, preferably near 100%, and more preferably 100% of all the acid of (a) and (b) are neutralized.

The thermoplastic composition preferably comprises melt-processible, highly-neutralized (greater than 90%, preferably near 100%, and more preferably 100%) polymer of (1) ethylene, $C_3$ to C8 α,β-ethylenically unsaturated carboxylic acid copolymers that have their crystallinity disrupted by addition of a softening monomer or other means such as high acid levels, and (2) non-volatile, non-migratory agents such as organic acids (or salts) selected for their ability to substantially or totally suppress any remaining ethylene crystallinity. Agents other than organic acids (or salts) may be used.

It has been found that, by modifying an acid copolymer or ionomer with a sufficient amount of specific organic acids (or salts thereof), it is possible to highly neutralize the acid copolymer without losing processibility or properties such as elongation and toughness. The organic acids employed in the present invention are aliphatic, mono-, di- or multi-functional, saturated or unsaturated organic acids, particularly those having fewer than 36 carbon atoms, and particularly those that are non-volatile and non-migratory and exhibit ionic array plasticizing and ethylene crystallinity suppression properties.

With the addition of sufficient organic acid, greater than 90%, nearly 100%, and preferably 100% of the acid moieties in the acid copolymer from which the ionomer is made can be neutralized without losing the processibility and properties of elongation and toughness.

The melt-processible, highly-neutralized acid copolymer ionomer can be produced by the following:

(a) melt-blending (1) ethylene α,β-ethylenically unsaturated $C_{3-8}$ carboxylic acid copolymer(s) or melt-processible ionomer(s) thereof (ionomers that are not neutralized to the level that they have become intractable, that is not melt-processible) with (1) one or more aliphatic, mono-, di- or multi-functional, saturated or unsaturated organic acids having fewer than 36 carbon atoms or salts of the organic acids, and then concurrently or subsequently (b) adding a sufficient amount of a cation source to increase the level of neutralization all the acid moieties (including those in the acid copolymer and in the organic acid) to greater than 90%, preferably near 100%, more preferably to 100%.

Preferably, highly-neutralized thermoplastics of the invention can be made by:

(a) melt-blending (1) ethylene, α,β-ethylenically unsaturated $C_{3-8}$ carboxylic acid copolymer(s) or melt-processible ionomer(s) thereof that have their crystallinity disrupted by addition of a softening monomer or other means with (2) sufficient non-volatile, non-migratory agents to substantially remove the remaining ethylene crystallinity, and then concurrently or subsequently (b) Adding a sufficient amount of a cation source to increase the level of neutralization all the acid moieties (including those in the acid copolymer and in the organic acid if the non-volatile, non-migratory agent is an organic acid) to greater than 90%, preferably near 100%, more preferably to 100%.

The acid copolymers used in the present invention to make the ionomers are preferably "direct" acid copolymers. They are preferably alpha olefin, particularly ethylene, $C_{3-8}$ α,β-ethylenically unsaturated carboxylic acid, particularly acrylic and methacrylic acid, copolymers. They may optionally contain a third softening monomer. By "softening", it is meant that the crystallinity is disrupted (the polymer is made less crystalline). Suitable "softening" co-monomers are monomers selected from alkyl acrylate, and alkyl methacrylate, wherein the alkyl groups have from 1–8 carbon atoms.

In another embodiment, the acid copolymers, when the alpha olefin is ethylene, can be described as E/X/Y copolymers where E is ethylene, X is the α,β-ethylenically unsaturated carboxylic acid, and Y is a softening comonomer. X is preferably present in 3–30 (preferably 4–25, most preferably 5–20) wt. % of the polymer, and Y is preferably present in 0–30 (alternatively 3–25 or 10–23) wt. % of the polymer.

Spheres were prepared using HNP ionomers A and B, as shown below.

TABLE I

| Sample | Resin Type (%) | Acid Type (%) | Cation (% neut*) | M.I. (g/10 min) |
|---|---|---|---|---|
| 1A | A (60) | Oleic (40) | Mg (100) | 1.0 |
| 2B | A (60) | Oleic (40) | Mg (105)* | 0.9 |
| 3C | B (60) | Oleic (40) | Mg (100) | 0.9 |
| 4D | B (60) | Oleic (40) | Mg (105)* | 0.9 |
| 5E | B (60) | Stearic (40) | Mg (100) | 0.85 |

A - ethylene, 14.8% normal butyl acrylate, 8.3% acrylic acid
B - ethylene, 14.9% normal butyl acrylate, 10.1% acrylic acid
*indicates that cation was sufficient to neutralize 105% of all the acid in the resin and the organic acid.

These compositions were molded into 1.53-inch spheres for which data is presented in the following table.

TABLE II

| Sample | Atti Compression | COR @ 125 ft/s |
|---|---|---|
| 1A | 75 | 0.826 |
| 2B | 75 | 0.826 |
| 3C | 78 | 0.837 |
| 4D | 76 | 0.837 |
| 5E | 97 | 0.807 |

Further testing of commercially available highly neutralized polymers HNP1 and HNP2 had the following properties.

TABLE III

| Material Properties | HNP1 | HNP2 |
|---|---|---|
| Specific Gravity | 0.966 | 0.974 |
| Melt Flow, 190° C., 10-kg load | 0.65 | 1.0 |
| Shore D Flex Bar (40 hr) | 47.0 | 46.0 |
| Shore D Flex Bar (2 week) | 51.0 | 48.0 |
| Flex Modulus, psi (40 hr) | 25,800 | 16,100 |
| Flex Modulus, psi (2 week) | 39,900 | 21,000 |
| DSC Melting Point (° C.) | 61.0 | 61/101 |
| Moisture (ppm) | 1500 | 4500 |
| Weight % Mg | 2.65 | 2.96 |

TABLE IV

| Solid Sphere Data | | | | | |
|---|---|---|---|---|---|
| Material | HNP1 | HNP2 | HNP2a | HNP1a | HNP1a/HNP2a (50:50 blend) |
| Spec. Grav. | 0.954 | 0.959 | 1.153 | 1.146 | 1.148 |
| Filler | None | None | Tungsten | Tungsten | Tungsten |
| Compression | 107 | 83 | 86 | 62 | 72 |
| COR | 0.827 | 0.853 | 0.844 | 0.806 | 0.822 |
| Shore D | 51 | 47 | 49 | 42 | 45 |
| Shore C | | | 79 | 72 | 75 |

These materials are exemplary examples of the preferred center and/or core layer compositions of the present invention. They may also be used as a cover layer herein.

Other suitable embodiments of the HNP's may be found in U.S. Pat. No. 6,653,382, U.S. patent application Ser. No. 10/797,699, U.S. patent application Publication Nos. 2003/0181260, 2003/0158352, 2003/0144087, 2003/144082, 2003/0130434, 2003/0013549, 2002/0091188, 2003/0181595, 2003/0114565, 2003/0050373, and 2002/0037968, and also WO 2004/02915, which are incorporated by reference in their entireties.

The diene rubber of the invention, in accordance to the "Nomenclature For Rubbers" by the Rubber Division of the American Chemical Society (available at http://www.rubber.org), may be natural rubber (NR), balata, gutta-percha, acrylate-butadiene rubber (ABR), bromo-isobutylene-isoprene rubber (BIIR), butadiene rubber (BR), chloro-isoprene-isoprene rubber (CIIR), chloroprene rubber (CR), ethylene-propylene-diene rubber (EPDM), ethylene-propylene rubber (EPM), guayule rubber (GR), hydrogenated acrylonitrile-butadiene rubber (HNBR), isobutylene-isoprene rubber (IIR), polyisobutylene rubber (IM), synthetic isoprene rubber (IR), acrylonitrile-butadiene rubber (NBR), acrylonitrile-chloroprene rubber (NCR), acrylonitrile-isoprene rubber (NIR), vinylpyridine-butadiene rubber (VPBR), vinylpyridine-styrene-butadiene rubber (PSBR), styrene-butadiene rubber (SBR), styrene-chloroprene rubber (SCR), styrene-isoprene rubber (SIR), carboxylic-styrene-butadiene rubber (XSBR), carboxylic-acrylonitrile-butadiene rubber (XNBR), any diene containing elastomer, and mixtures thereof.

Typically natural or synthetic base rubber is used, which includes polydienes, polyethylenes (PE), ethylene-propylene copolymers (EP), ethylene-butylene copolymers, polyisoprenes, polybutadienes (PBR), polystyrenebutadienes, polyethylenebutadienes, styrene-propylene-diene rubbers, ethylene-propylene-diene terpolymers (EPDM), fluorinated polymers thereof (e.g., fluorinated EP and fluorinated EPDM), and blends of one or more thereof. Preferred base rubbers are PBR and EPDM. Suitable PBR may have high 1,4-cis content (e.g., at least 60%, preferably greater than about 80%, more preferably at least about 90%, and most preferably at least about 95%), low 1,4-cis content (e.g., less than about 50%), high 1,4-trans content (e.g., at least about 40%, preferably greater than about 70%, such as about 75% or 80%, more preferably greater than about 90%, such as about 95%), low 1,4-trans content (e.g., less than about 40%), high 1,2-vinyl content (e.g., at least about 40%, such as about 50% or 60%, preferably greater than about 70%), or low 1,2-vinyl content (e.g., less than about 30%, such as about 5%, 10%, 12%, 15%, or 20%). PBR can have various combinations of cis-, trans-, and vinyl structures, such as having a trans-structure content greater than cis-structure content and/or 1,2-vinyl structure content, having a cis-structure content greater than trans-structure content and/or 1,2-vinyl structure content, or having a 1,2-vinyl structure content greater than cis-structure content or trans-structure content. Obviously, the various polybutadienes may be utilized alone or in blends of two or more thereof to formulate different compositions in forming golf ball components (cores, covers, and portions or layers within or in between) of any desirable physical and chemical properties and performance characteristics.

Other parameters used in determining suitable base rubber materials include Mooney viscosity, solution viscosity, weight or number average molecular weights, and polydispersity, among others. Mooney viscosity is typically measured according to ASTM D-1646. Material hardness is defined by the procedure set forth in ASTM-D2240 and generally involves measuring the hardness of a flat "slab" or "button" formed of the material of which the hardness is to be measured. Hardness, when measured directly on a golf ball (or other spherical surface) is a completely different measurement and, therefore, results in a different hardness value. This difference results from a number of factors including, but not limited to, ball construction (i.e., core type, number of core and/or cover layers, etc.), ball (or sphere) diameter, and the material composition of adjacent layers. It should also be understood that the two measurement techniques are not linearly related and, therefore, one hardness value cannot easily be correlated to the other. As used herein, the term "hardness" refers to material hardness, as defined above. When golf balls are prepared according to the invention, they typically will have dimple coverage greater than about 60 percent, preferably greater than about 65 percent, and more preferably greater than about 75 percent. The flexural modulus of the cover on the golf balls, as measured by ASTM method D6272-98, Procedure B, is typically greater than about 500 psi, and is preferably from about 500 psi to 150,000 psi.

The base rubber may comprise rubbers of high Mooney viscosity. Preferably, the base rubber has a Mooney viscosity greater than about 35, more preferably greater than about 50, such as mid Mooney viscosity range of about 40 to about 60, or high Mooney viscosities of greater than about 65. Preferably, the polybutadiene rubber has a weight average molecular weight greater than about 400,000 and a polydispersity of no greater than about 2. A common indicator of the degree of molecular weight distribution of a polymer is its polydispersity, defined as the ratio of weight average molecular weight, $M_w$, to number average molecular weight, $M_n$. Polydispersity ("dispersity") also provides an indication of the extent to which the polymer chains share the same degree of polymerization. If the polydispersity is 1.0, then all polymer chains must have the same degree of polymerization. Since $M_w$ is always equal to or greater than $M_n$, polydispersity, by definition, is equal to or greater than 1.0. Such rubber compounds are commercially available from Bayer of Akron, Ohio, UBE Industries of Tokyo, Japan, and Shell of Houston, Tex., among others.

The base rubber may also be mixed with other elastomers, particularly diene and saturated rubbers, known in the art, such as natural rubbers, polyisoprene rubbers, styrene-butadiene rubbers, diene rubbers, saturated rubbers, polyurethane rubbers, polyurea rubbers, metallocene-catalyzed polymers, plastomers, and multi-olefin polymers (homopolymers, copolymers, and terpolymers) in order to modify the properties of the core. With a major portion (greater than 50% by weight, preferably greater than about 80%) of the base rubber being a polybutadiene or a blend of two, three, four or more polybutadienes, these other miscible elastomers are present in amounts of less than 50% by weight of the total base rubber, preferably in minor quantities such as less than about 30%, less than about 15%, or less than about 5%. In one embodiment, the polymeric composition comprises less than about 20% balata, such as 18% or less, or 10% or less, and preferably is substantially free of balata (i.e., less than about 2%).

Suitable co-crosslinking agents all have di- or polyunsaturation and at least one readily extractable hydrogen in the cc position to the unsaturated bonds. Useful co-crosslinking agents include, but are not limited to, mono- or polyfanctional unsaturated carboxylate metallic compounds, polyesters, polyamides, or esteramides of unsaturated carboxylic acids, bismaleimides, allyl esters of cyanurates, allyl esters of isocyanurates, allyl esters of aromatic acids, mono- and polyunsaturated polycarboxylic acids and anhydrides and esters thereof, liquid vinyl 1,2-polybutadiene homopolymers and copolymers, and mixtures thereof. Unsaturated carboxylate functional compounds are Type I co-crosslinking agents. They differ from all others, which are Type II co-crosslinking agent, in their effect on the curing characteristics of the system. Type I co-crosslinking agents generally form relatively more reactive free radicals which increase both cure rate and the state of cure of the system, and form ionic crosslinks primarily. Type II co-crosslinking agents form relatively less reactive and more stable free radicals and increase primarily the state of cure of the elastomer, and primarily form carbon-carbon crosslinks. The co-crosslinking agent is present in the amount from about 2 parts per one-hundred parts by weight of the base rubber (phr) to about 60 phr, such as about 5 phr, 10 phr, 15 phr, 20 phr, 25 phr, 30 phr, or 40 phr.

Unsaturated carboxylate functional compounds typically have one or more α,β-ethylenically unsaturated carboxylate functionalities such as acrylates and methacrylates. Preferably, the compounds also have one or more metal ions associated with one or more of the unsaturated carboxylate functionalities, such as Zn, Ca, Co, Fe, Mg, Ti, Ni, Cu, etc. Alternatively, the unsaturated carboxylate functional compounds are condensation products of unsaturated carboxylic acids with polyamines (forming polyamides), polyols (forming polyesters), or aminoalcohols (forming esteramides), such as, without limitation, tripropylene glycol diacrylate, Bisphenol A diglycidylether diacrylate, 1,6-Hexanediol diacrylate, 1,4-butanediol dimethacrylate, ethyleneglycol dimethacrylate, polyethylene glycol dimethacrylate, diethylene glycol dimethacrylate, urethane dimethacrylate, tetraethylene glycol dimethacrylate, triethylene glycol dimethacrylate, trimethylolpropane trimethacrylate, pentaerythritol triacrylate, and trimethylopropane triacrylate. Metallic compounds of difunctional unsaturated carboxylates include, without limitation, zinc diacrylate (ZDA), zinc dimethacrylate (ZDMA), calcium diacrylate, and a blend thereof. Metallic compounds of polyfunctional unsaturated carboxylates include reaction products of a) mono-basic unsaturated carboxylic acids such as acrylic acid and/or methacrylic acid, b) di-basic and/or polybasic carboxylic acids having mono- or polyunsaturation, and/or anhydrides thereof, such as those disclosed herein below, and c) divalent metal oxide. Examples of such metallic compounds and their synthesis are disclosed in U.S. Pat. No. 6,566,483, the entirety of which is incorporated herein by reference.

Non-limiting example of bismaleimide is N,N'-m-phenylenedimaleimide (HVA-2, available from Dupont). Non-limiting examples of allyl esters include triallyl cyanurate (Akrosorb® 19203, available from Akrochem Corp. of Akron, Ohio), triallyl isocyanurate (Akrosorb® 19251, also available from Akrochem Corp.), and triallyl trimaletate (TATM, available from Sartomer Company of Exton, Pa.). Non-limiting examples of mono- or polyunsaturated polycarboxylic acids and anhydrides and esters thereof include citraconic acid, itaconic acid, fumaric acid, maleic acid, mesaconic acid, aconitic acid, maleic anhydride, itaconic anhydride, citraconic anhydride, poly(meth)acrylic acid, polyitaconic acid, copolymers of (meth)acrylic acid and maleic acid, copolymers of (meth)acrylic acid and styrene, and fatty acids having a $C_6$ or longer chain, such as hexadecenedioic acid, octadecenedioic acid, vinyl-tetradecenedioic acid, eicosedienedioic acid, dimethyl-eicosedienedioic acid, 8-vinyl-10-octadecenedioic acid, methyl, ethyl, and other esters thereof, and mixtures thereof.

Liquid vinyl 1,2-polybutadiene homopolymers and copolymers can have low to moderate viscosity, low volatility and emission, high boiling point (typically greater than 300° C.), and molecular weight of about 1,000 to about 5,000, preferably about 1,800 to about 4,000, more preferably about 2,000 to about 3,500. Commercial examples of these liquid vinyl 1,2-polybutadienes include RICON® 154 (90% high vinyl 1,2-polybutadiene having a molecular weight of about 3,200), RICON® 150 (70% high vinyl 1,2-polybutadiene having a molecular weight of about 2,400), and RICON® 100 (70% high vinyl 1,2-polybutadiene/styrene copolymer having a molecular weight of about 2,400), all of which are available from Ricon Resins, Inc. of Grand Junction, Colo.

The cis-to-trans catalyst or organosulfur compound, preferably halogenated, is a compound having cis-to-trans catalytic activity or a sulfur atom (or both), and is present in the polymeric composition by at least about 0.01 phr, preferably at least about 0.05 phr, more preferably at least about 0.1 phr, even more preferably greater than about 0.25 phr, optionally greater than about 2 phr, such as greater than about 2.2 phr, or even greater than about 2.5 phr, but no more than about 10 phr, preferably less than about 5 phr, more preferably less than about 2 phr, even more preferably less than about 1.1 phr, such as less than about 0.75 phr, or even less than about 0.6 phr. Useful compounds of this category include those disclosed in U.S. Pat. Nos. 6,525,141, 6,465,578, 6,184,301, 6,139,447, 5,697,856, 5,816,944, and 5,252,652, the disclosures of which are incorporated by reference in their entirety.

One group of suitable organosulfur compounds are halogenated thiophenols and metallic compounds thereof, which are exemplified by pentafluorothiophenol, 2-fluorothiophenol, 3-fluorothiophenol, 4-fluorothiophenol, 2,3-fluorothiophenol, 2,4-fluorothiophenol, 3,4-fluorothiophenol, 3,5-fluorothiophenol 2,3,4-fluorothiophenol, 3,4,5-fluorothiophenol, 2,3,4,5-tetrafluorothiophenol, 2,3,5,6-tetrafluorothiophenol, 4-chlorotetrafluorothiophenol, pentachlorothiophenol, 2-chlorothiophenol, 3-chlorothiophenol, 4-chlorothiophenol, 2,3-chlorothiophenol, 2,4-chlorothiophenol, 3,4-chlorothiophenol, 3,5-chlorothiophenol, 2,3,4-chlorothiophenol, 3,4,5-chlorothiophenol, 2,3,4,5-tetrachlorothiophenol, 2,3,5,6-tetrachlorothiophenol, pentabromothiophenol, 2-bromothiophenol, 3-bromothiophenol, 4-bromothiophenol, 2,3-bromothiophenol, 2,4-bromothiophenol, 3,4-bromothiophenol, 3,5-bromothiophenol, 2,3,4-bromothiophenol, 3,4,5-bromothiophenol, 2,3,4,5-tetrabromothiophenol, 2,3,5,6-tetrabromothiophenol, pentaiodothiophenol, 2-iodothiophenol, 3-iodothiophenol, 4-iodothiophenol, 2,3-iodothiophenol, 2,4-iodothiophenol, 3,4-iodothiophenol, 3,5-iodothiophenol, 2,3,4-iodothiophenol, 3,4,5-iodothiophenol, 2,3,4,5-tetraiodothiophenol, 2,3,5,6-tetraiodothiophenoland, the metal salts thereof, and mixtures thereof. The metal ions, when present, are associated with the thiophenols, and are chosen from zinc, calcium, magnesium, cobalt, nickel, iron, copper, sodium, potassium, and lithium, among others. Halogenated thiophenols associated with organic cations such as ammonium are also useful for the present invention.

More specifically, workable halogenated thiophenols include pentachlorothiophenol, zinc pentachlorothiophenol, magnesium pentachlorothiophenol, cobalt pentachlorothiophenol, pentafluorothiophenol, zinc pentafluorothiophenol, and blends thereof. Preferred candidates are pentachlorothiophenol (available from Strucktol Company of Stow, Ohio), zinc pentachlorothiophenol (available from eChinachem of San Francisco, Calif.), and blends thereof.

Another group of suitable organosulfur compounds are organic disulfides which include, without limitation, perhalogenated (i.e., fully halogenated) organic disulfides and organometallic disulfides. Perhalogenated compounds are preferably perfluorinated, perchlorinated, and/or perbrominated. Perhalogenated organic disulfides include perhalogenated derivatives of any and all organic disulfides known and/or available to one skilled in the art, which include those disclosed herein, such as ditolyl disulfides, diphenyl disulfides, quinolyl disulfides, benzoyl disulfides, and bis(4-acryloxybenzene)disulfide, among others. A particular example is perchloroditolyl disulfide. Organometallic disulfides include combinations of any metal cations disclosed herein with any organic disulfides disclosed herein. A particular example is zinc ditolyl disulfide.

Suitable crosslinking initiators include any known polymerization initiators known or available to one skilled in the art that are capable of generating reactive free radicals. Such initiators include, but are not limited to, sulfur and organic peroxide compounds. Preferred peroxide initiators are dialkyl peroxides which include, without limitation, di-t-amyl peroxide, di-t-butyl peroxide, t-butyl cumyl peroxide, di-cumyl peroxide (DCP), di(2-methyl-1-phenyl-2-propyl) peroxide, t-butyl 2-methyl-1-phenyl-2-propyl peroxide, di(t-buylperoxy)-diisopropylbenzene (higher crosslinking efficiency, low odor and longer scorch time), 2,5-dimethyl-2,5-di(t-butylperoxy)hexane, 2,5-dimethyl-2,5-di(t-butylperoxy)hexyne-3,1,1-di(t-butylperoxy)-3,3,5-trimethylcyclohexane, 4,4-di(t-butylperoxy)-n-butylvalerate, and mixtures thereof. DCP is the most commonly used peroxide in golf ball manufacturing. Di(t-buylperoxy)-diisopropylbenzene is a preferred peroxide because of its higher crosslinking efficiency, low odor and longer scorch time, among other properties. It is also preferred to use a blend of DCP and di(t-buylperoxy)-diisopropylbenzene. In the pure form, the peroxide or blend of peroxides is used at an amount of about 0.25 phr to about 2.5 phr.

Any filler known or available to one skilled in the art can be used in any desired quantity to alter a property of the various golf ball portions, including specific gravity, color/appearance, flexural modulus, moment of inertia, and rheological properties, among others. Suitable fillers include, but are not limited to, tungsten, zinc oxide, barium sulfate, silica, metal oxides, and ceramic materials. The fillers may be used in the forms of particulates, fibers, flakes, whiskers, filaments, etc. Dual-functional fillers are often used. For example, zinc oxide is also known for its cross-link activities, and is often used as a dual filler/initiator material, while titanium oxide is used as a dual filler/brightener material.

Other additives may be chosen from those known or available to one skilled in the art, and used in appropriate quantities to achieve the desirable effects. For example, suitable antioxidants include di(t-butyl)hydroquinone and others as disclosed in U.S. Pat. No. 4,974,852, which is incorporated herein by reference entirely. Suitable moisture scavengers include p-toluolsulfonyl isocyanate (PTSI) and polymeric methylene diphenyl diisocyanate (PAPI® MDI from Dow Chemical), used in an amount of less than about 10 phr, preferably abot 0.1 phr to about 5 phr. Various light stabilizers, UV absorbers, photoinitiators, and silane crosslinkers are all readily available.

In another embodiment, the DR component may further comprise a halogenated organosulfur compound, preferably between about 0.01 parts and about 5 parts, more preferably about 0.25 to 2.5 parts.

In a different embodiment, the DR component may further comprise a base rubber, a crosslinking agent, a filler, a halogenated organosulfur compound, and a co-crosslinking or initiator agent. The base rubber typically includes natural or synthetic rubbers. A preferred base rubber is 1,4-polybutadiene having a cis-structure of at least 40%, more preferably at least about 90%, and most preferably at least about 95%. Most preferably, the base rubber comprises high-Mooney-viscosity rubber. Preferably, the base rubber has a Mooney viscosity greater than about 35, more preferably greater than about 50. Preferably, the polybutadiene rubber has a molecular weight greater than about 400,000 and a polydispersity of no greater than about 2. Examples of desirable polybutadiene rubbers include BUNA® CB22 and BUNA® CB23, commercially available from Bayer of Akron, Ohio; UBEPOL® 360L and UBEPOL® 150L, commercially available from UBE Industries of Tokyo, Japan; and CARIFLEX® BCP820, CARIFLEX® 1220 and CARIFLEX® BCP824, commercially available from Shell of Houston, Tex.; and KINEX® 7245 and KINEX® 7265, commercially available from Goodyear of Akron, Ohio. If desired, the DR can also be mixed with other elastomers known in the art such as natural rubber, polyisoprene rubber and/or styrene-butadiene rubber in order to modify the properties of the core. Other suitable DR for this invention can also be found in commonly owned U.S. Pat. No. 6,635,716 to Voorheis et al., which is incorporated by reference in its entirety.

In another embodiment, the DR component is formed from a blend of two polybutadiene rubbers, one made with a cobalt or nickel catalyst and having a higher Mooney viscosity between about 40 and about 150, another made with a lanthanide series catalyst and having a lower Mooney viscosity between about 30 and about 100. In one embodiment, a neodymium catalyst is the lanthanide series catalyst. The blend has more of the Co/Ni-DR and less of the Nd-DR, with a ratio of weight percentage between the two being preferably at least about 51:49, more preferably at least about 60:40, and most preferably at least about 75:25.

In another embodiment of the invention, the Co/Ni-DR has a Mooney viscosity between about 60 and about 150, a number average molecular weight between about 150,000 and about 250,000, and a polydispersity between about 1.50 and about 3.50, while the Nd-DR has a Mooney viscosity between about 35 and about 90, a number average molecular weight between about 150,000 and about 275,000, and a polydispersity between about 1.25 and about 2.75. In a different embodiment, the Mooney viscosity of the Co/Ni-DR is between about 70 and about 130, and the Mooney viscosity of the Nd-DR is between about 45 and about 80. The polybutadiene blend also has a cis-1,4 bond content of at least about 80% in the polymer chains, and in one embodiment, it comprises at least about 65% by weight of the golf ball core, in another embodiment, it comprises between about 70% and about 85% by weight of the golf ball core.

Additional suitable DR may be found in U.S. patent application Publication Nos. 2003/0022913 and 2003/0207998 by Voorheis et al., which are incorporated by reference in their entireties. The '913 publication relates to a golf ball core comprising a DR composition, wherein the DR is a blend of (a) a first polybutadiene having a first Mooney viscosity between about 40 and about 150, and (b) a second polybutadiene having a second Mooney viscosity between about 30 to about 100. The '913 publication also teaches the use of HNP's as part of a golf ball cover. On the other hand, the '998 publication discloses materials for solid cores comprising a base rubber, a crosslinking agent, a filler, halogenated organosulfur compound and a co-crosslinking or initiator agent. The '998 publication also teaches the blending of HNP's with a second polymer component such as DR.

In one embodiment, suitable DR compositions that may be blended with HNP include: (a) regrinds of DR compositions, (b) sulfur-cured DR compositions, in which polymer chains are joined together by sulfur-sulfur bridges using a vulcanizing agent, or alternatively known as "pre-vulcanized" DR, and (c) peroxide-cured DR compositions, in which peroxides or free-radicals are used as crosslinking agents between rubber polymer chains, or alternatively known as "pre-crosslinked" DR.

"Regrind" refers to cured golf ball core stock or any excess flash generated during the molding process that have been ground into small particles. The regrinds may be put back into the core formulations as filler.

"Pre-vulcanized" materials include sulfur-based chemical compounds that already have been vulcanized, in particular, polymer chains joined together (i.e., crosslinked) by sulfur-sulfur bridges to give a three dimensional polymeric network.

Sulfur, in some instances, is a desirable cross-linking agent for vulcanization of natural rubbers because it provides the newly formed rubber articles with increased strength and excellent resistance to failure when flexed. Insoluble sulfur may be used in natural rubber compounds in order to promote adhesion, which is necessary for certain applications. These insoluble sulfur rubber mixtures, however, must be kept cool (<100° C.) or the amorphous polymeric form converts to rhombic crystals, which may destroy building tack and lead to failure of the bond. In addition to insoluble sulfur, sulfur donors may be used. Examples of sulfur donors include 4-morpholinyl-2-benzothiazole disulfide (MBSS), dipentamethylenethiuram hexasulfide (DPTH) and thiuram disulfides. These sulfur donors donate one atom of sulfur from their molecular structure for cross-linking purposes and thus provide thermal stability. Examples of preferred sulfur curing agents include, but are not limited to N-oxydiethylene 2-benzothiazole sulfenamide, N,N-diorthotolyguanidine, bismuth dimethyldithiocarbamate, N-cyclohexyl 2-benzothiazole sulfenamide, N,N-diphenylguanidine, or combinations thereof.

"Pre-crosslinked" materials include chemical compounds that already have been crosslinked, in particular, polymer chains that are joined together or crosslinked by peroxides or free radicals. Typically, pre-crosslinked materials contain polymer chains are joined together by chemical bridges that are not sulfur-sulfur bridges. For example, the polymer chains can contain peroxide moieties and/or free radicals that react with other peroxide moieties and/or free radicals of other polymer chains to form crosslinked material. In another example, peroxides, free radicals and/or free radical-generators are contacted with the polymer chains to facilitate crosslinking between polymer chains.

Peroxides can also be used as a cross-linking agent for natural rubbers because peroxides give carbon-carbon cross-links, which can provide rubber articles with increased resistance to heat, oxygen and compression set. Peroxides can be advantageous in cross-linking in that they can be used in polymer blends and also with fully saturated polymers that cannot be cross-linked by other methods. In peroxide cross-linking, exposure to air is generally avoided, sometimes by means of an antioxidant, such as polymerized 1,2-dihydro-2,2,4-trimethylquinoline. Coagents, such as polybutadiene or multifunctional methacrylates, can also be used with peroxides to increase the state of cure.

Suitable peroxide curing agents are dicumyl peroxide; 2,5-dimethyl-2,5-di(t-butylperoxy) hexane; 2,5-dimethyl-2,5-di(t-butylperoxy)hexyne; 2,5-dimethyl-2,5-di(benzoylperoxy)hexane; 2,2'-bis(t-butylperoxy)-di-iso-propylbenzene; 1,1-bis(t-butylperoxy)-3,3,5-trimethyl cyclohexane; n-butyl 4,4-bis(t-butyl-peroxy)valerate; t-butyl perbenzoate; benzoyl peroxide; n-butyl 4,4'-bis(butylperoxy)valerate; di-t-butyl peroxide; 2,5-di-(t-butylperoxy)-2,5 dimethyl hexane; or combinations thereof.

In comparing the physical attributes of sulfur vulcanizing agents versus peroxide cross-linking agents, there are clear differences in the physical characteristics. For example, the molecular weights of vulcanizing agents (outside of insoluble sulfur) are generally lower than peroxide cross-linking agents. Further, the density of most of the vulcanizing agents is higher than the density of the peroxide cross-linking agents. When (a) regrinds of DR compositions, (b) pre-vulcanized or sulfur-cured DR compositions, and (c) pre-crosslinked DR compositions are blended with HNP's, materials with different physical characteristics are resulted.

Further details of the use of pre-vulcanized or pre-crosslinked materials may be found in commonly-owned and co-pending U.S. patent applications Ser. Nos. 10/606,841 and 10/607,133, which are incorporated by reference in their entireties. Also, further details as to the properties and formulations of the vulcanizing agents and peroxides may be found in U.S. Pat. No. 6,695,718 to Nesbitt, which is incorporated by reference in its entirety.

Dynamically vulcanized alloy (DVA) may be formed when two polymeric components are melt blended with a curative such that one polymeric component is being dynamically vulcanized in the presence of another polymeric component that is essentially not crosslinked. In this invention, a DR is crosslinked, i.e,. vulcanized, dynamically by a curative in the presence of an HNP, which is essentially not crosslinked. The degree of crosslinking or curing of the DR is at least partial, and preferably full or complete. For the purpose of this invention, any degree of crosslinking or curing of the DR is compatible for the formation of DVA.

In one embodiment, when HNP and DR are blended to form DVA, it is believed that the crosslinked DR will be present as discretely dispersed phase in a continuous matrix of the HNP. The HNP component in this embodiment occupies the majority of the total volume of the DVA. In another embodiment, it is possible that both crosslinked DR and the HNP are about equal proportions in the DVA. In a different embodiment, the HNP is present as discretely dispersed phase in a continuous matrix of the crosslinked DR. In this embodiment, the crosslinked DR occupies the majority of the volume of the DVA.

According to A. Y. Coran and R. P. Patel's article "Thermoplastic Elastomers Based on Dynamically Vulcanized Ealstomer-Thermoplastic Blends" in "Thermoplastic Eastomers" (G. Holden, N. et al., eds. Hanser/Gardener Publications, 2d ed., 1996), which is incorporated by reference in its entirety, dynamic vulcanization is a method that gives rise to new thermoplastic having many new properties that are as good, or in some cases, even better than those of the original elastomeric block copolymers. In addition, these dynamic vulcanization products can provide compositions that are very elastomeric in their performance, and can readily be further fabricated into the finished parts using thermoplastic processing equipment.

According to Coran and Patel, dynamically vulcanized blends of elastomer and plastic may be prepared by first melt mixing the elastomer and the plastic in an internal mixer. After a well-mixed blend is formed, vulcanization agents (i.e., curatives or crosslinkers) are added, and vulcanization occurs while mixing continues. The faster the rate of vulcanization, the more intense the mixing must be to ensure good fabricability of the blend composition. Examples of dynamic vulcanizates include ethylene-propylene-diene terpolymer (EPDM)-polyolefin thermoplastic vulcanizates, DR-polyolefin-based thermoplastic vulcanizates, and butyl rubber-polypropylene-based thermoplastic vulcanizates. Examples of the DR that can be used on blends of polyolefins, include butyl rubber, natural rubber, NBR and SBR. These blends have been found to result in compositions with fairly good initial tensile properties, and their thermal stability is somewhat better than that of thermoset DR.

According to U.S. Pat. No. 5,936,039 to Wang et al., which is also incorporated by reference in its entirety, the method of making thermoplastic elastomer comprising triblend of (a) DVA of thermoplastic olefin polyer and elastomeric copolymer, (b) an engineering resin and (c) a compatibilizer for the DVA and the engineering resin.

The engineering resins in the triblend are amorphous or semicrystalline materials, usually polar in nature, with a glass transition temperature ($T_g$) or melting point above about 150° C., preferably above about 200° C. The engineering resin may be used singularly or in combination. Examples of engineering resins that may be used include polyamides, polycarbonates, polyesters, polysulfones, polylactones, polyacetals, acrylonitrile-butadienestyrene (ABS) resins, polyphenylene oxide (PPO), polyphenylene sulfide (PPS), styreneacrylonitrile (SAN) resins, polyimides, styrene maleic anhydride (SMA) and aromatic polyketones. Preferred thermoplastic engineering resins are polyamides. The more preferred polyamides are nylon 6, nylon 6,6, nylon 11, nylon 12 and mixtures or copolymers thereof.

The compatibilizer in the triblend provides an interfacial adhesion between the DVA and the engineering resin. Without the compatibilizer, blends of engineering resin and DVA have poor mechanical elongation properties, and as a result, the weak interfaces between the components may fail and the components may delaminate. Therefore, the compatibilizer is designed so that each segment or functional group is compatible with one of the major component phases, and incompatible with the other. The compatibilizer may be regarded as a material which improves the interfacial adhesion of the major component phases in a thermoplastic elastomer composition by connecting the component phases, forming a stable blend.

Here in this invention, the term "dynamic vulcanization" is a process in which the DR is vulcanized or cured in the presence of the HNP's under conditions of high shear and at a temperature that is above the melting point of the HNP's. The resulting DVA of a DR and an HNP contain fully or partially crosslinked DR particles in sizes ranging from microns to submicrons being dispersed in a matrix of the HNP's. The unique characteristic of the DVA is that the DVA can be processed and reprocessed by conventional DR processing techniques such as extrusion, injection molding, blow molding and compression molding. The terms "fully vulcanized" and "completely vulcanized" represent that the DR component in the DVA has been vulcanized to the stage that the elastomeric properties are similar to those of the vulcanized DR apart from the blending with the HNP's.

It has now been discovered that golf balls having an interpenetrating polymer network, including at least two polymeric components, can advantageously provide improved golf balls. An IPN useful for the present invention may include two or more different polymers or polymer networks and can encompass any one or more of the different types of IPN's listed and described below, which may overlap:

(1) Sequential IPN's, in which monomers or prepolymers for synthesizing one polymer or a polymer network are polymerized in the presence of another polymer or polymer network. These networks may have been synthesized in the presence of monomers or prepolymers of the one polymer or polymer network, which may have been interspersed with the other polymer or polymer network after its formation or cross-linking;

(2) Simultaneous IPN's, in which monomers or prepolymers of two or more polymers or polymer networks are mixed together and polymerized and/or crosslinked simultaneously, such that the reactions of the two polymer networks do not substantially interfere with each other;

(3) Grafted IPN's, in which the two or more polymers or polymer networks are formed such that elements of the one polymer or polymer network are occasionally attached or covalently or ionically bonded to elements of an/the other polymer(s) or polymer network(s);

(4) Semi-IPN's, in which one polymer is crosslinked to form a network while another polymer is not; the polymerization or crosslinking reactions of the one polymer may occur in the presence of one or more sets of other monomers, prepolymers, or polymers, or the composition may be formed by introducing the one or more sets of other monomers, prepolymers, or polymers to the one polymer or polymer network, for example, by simple mixing, by solublizing the mixture, e.g., in the presence of a removable solvent, or by swelling the other in the one;

(5) Full, or "true," IPN's, in which two or more polymers or sets of prepolymers or monomers are crosslinked (and thus polymerized) to form two or more interpenetrating crosslinked networks made, for example, either simultaneously or sequentially, such that the reactions of the two polymer networks do not substantially interfere with each other;

(6) Homo-IPN's, in which one set of prepolymers or polymers can be further polymerized, if necessary, and simultaneously or subsequently crosslinked with two or more different, independent crosslinking agents, which do not react with each other, in order to form two or more interpenetrating polymer networks;

(7) Gradient IPN's, in which either some aspect of the composition, frequently the functionality, the copolymer content, or the crosslink density of one or more other polymer networks gradually vary from location to location within some, or each, other interpenetrating polymer network(s), especially on a macroscopic level;

(8) Thermoplastic IPN's, in which the crosslinks in at least one of the polymer systems involve physical crosslinks, e.g., such as very strong hydrogen-bonding or the presence of crystalline or glassy regions or phases within the network or system, instead of chemical or covalent bonds or crosslinks; and (9) Latex IPN's, in which at least one polymer or set of prepolymers or monomers are in the form of latices, frequently (though not exclusively) in a core-shell type of morphology, which form an interpenetrating polymer network when dried, for example, as a coating on a substrate (if multiple polymers or sets of prepolymers or monomers are in the form of lattices, this is sometimes called an "interpenetrating elastomer network," or IEN).

An IPN according to the invention does not include a copolymer network. The term "copolymer network," as used herein, can be defined as a single polymer network formed from two or more different types of monomers, oligomers, precursor packages, or polymers, during which network formation: (a) the crosslinking reaction(s) result(s) in the different types of polymers, oligomers, or precursors being sufficiently inter-crosslinked, i.e., the polymers, oligomers, or precursors of one or more types are connected to polymers, oligomers, or precursors of the other different types, such that effectively one crosslinked network connecting all the different monomers, oligomers, precursors, or polymers is formed; (b) the contemporaneous or consecutive polymerization reaction(s) of all the different types of monomers, oligomers, or precursors result(s) in two or more different types of copolymers, which may themselves be oligomeric or polymeric and may be precursors to (an)other type(s) of copolymer(s), and which may then undergo inter-crosslinking reaction(s), as in a), between the different types of copolymers; (c) the contemporaneous or consecutive polymerization reaction(s) of all the different types of monomers, oligomers, or precursors result(s) in a single type of copolymer, which may itself be oligomeric or polymeric and may be a precursor to another type of copolymer, and which may then undergo a sufficient intra-crosslinking reaction, i.e., the copolymer chains of the single type are connected to other copolymer chains of the same type, such that effectively a single crosslinked network connecting copolymer chains is formed; or (d) any combination thereof.

A grafted IPN is distinguishable from a copolymer network, in that the inter-crosslinking of a grafted IPN is only occasional, resulting in relatively few cross-type polymer linkages, while the inter-crosslinking of a copolymer network occurs relatively frequently, resulting in a relatively large amount of cross-type polymer linkages. As a result, the copolymer network is effectively a single copolymer network, while the grafted IPN according to the invention may be lightly inter-crosslinked but is effectively a combination of at least two, preferably co-continuous, polymer networks. Preferably, grafted IPNs according to the invention have a substantial lack of cross-type polymer linkages, or inter-crosslinking. In one embodiment, a layer containing a gradient IPN according to the invention has a flexural modulus below about 5 ksi.

In one embodiment of this invention, the HNP in the IPN is in a continuous phase. In another embodiment of this invention, the DR in the IPN is in a continuous phase. In a different embodiment of this invention, both the HNP and the DR in the IPN are in co-continuous phases. These different embodiments having at least one of HNP and DR to be in a continuous phase will exhibit different properties from those embodiments in which neither HNP nor DR are in a continuous phase. In yet another embodiment, the HNP and the DR form both a DVA and an IPN, exhibiting properties that are useful for the construction of the at least one layer of a golf ball.

In one embodiment of the present invention, a blend of an HNP and a DR, in a DVA, or in an IPN, or in a DVA and an IPN, is used for at least one layer of a golf ball, wherein the golf ball comprises a core, a core layer, a cover, or a cover layer. Alternatively, the blend of an HNP and a DR, in a DVA, or in an IPN, or in a DVA and an IPN, may be used for a one-piece golf ball.

Other suitable embodiments of IPN may be found in commonly owned, co-pending U.S. patent application Publication No. 2002/0187857 by Kuntimaddi et al., which relates to a golf ball that contains at least two polymeric components in IPN in any layer of the golf ball.

In this invention, the properties such as core diameter, intermediate layer thickness and cover layer thickness, hardness, and compression have been found to effect play characteristics such as spin, initial velocity and feel of the present golf balls.

In one embodiment of this invention, dimensions of golf ball components, i.e., thickness and diameter, may vary depending on the desired properties. For the purposes of the invention, any layer thickness may be employed. For example, the overall golf ball size may range from about 1.68 inches to about 1.8 inches, preferably about 1.68 inches to about 1.76 inches, and more preferably about 1.68 inches to about 1.74 inches. Large overall diameters are also contemplated (e.g., up to about 1.95 inches).

In another embodiment, the core may have a diameter ranging from about 0.25 inches to about 1.65 inches. In a different embodiment, the diameter of the core of the present invention is about 1.2 inches to about 1.630 inches. In yet another embodiment, the diameter of the core is about 1.30 inches to about 1.6 inches. More preferably, the core has a diameter of about 1.25 inches to about 1.65 inches. In another embodiment, the core diameter is about 1.59 inches or greater. In a different embodiment, the diameter of the core is about 1.64 inches or less.

When the core includes an inner core layer and an outer core layer, the inner core layer is preferably about 1.25 inches or greater, and the outer core layer preferably has a thickness of about 0.05 inches, and more preferably 0.10 inches or greater. In one embodiment, the inner core layer has a diameter from about 0.25 inches to about 1.62 inches, and more preferably 0.50 inches to 1.60 inches, and still more preferably from 1.00 inches to 1.55 inches. In the same embodiment, the outer core layer has a thickness from about 0.1 inches to about 0.8 inches. In yet another embodiment, the inner core diameter is about 0.095 inches to about 1.1 inches, and the outer core layer has a thickness of about 0.20 inches to about 0.50 inches.

In this invention, the cover typically has a thickness to provide sufficient strength, good performance characteristics, and durability. In one embodiment, the cover thickness is from about 0.015 inches to about 0.12 inches, preferably about 0.1 inches or less. In another embodiment, the cover thickness is about 0.05 inches or less, preferably from about 0.02 inches to about 0.05 inches, and more preferably from about 0.02 inches to about 0.045 inches.

The range of thicknesses for an intermediate layer of a golf ball is large because of the vast possibilities when using an intermediate layer, i.e., as an outer core layer, an inner cover layer, a wound layer, or a moisture/vapor barrier layer. When used in a golf ball of the invention, the intermediate layer, or inner cover layer, may have a thickness of about 0.3 inches or less. In one embodiment, the thickness of the intermediate layer is from about 0.002 inches to about 0.1 inches, preferably about 0.01 inches or greater. In another embodiment, the intermediate layer thickness is about 0.05 inches or less, more preferably about 0.01 inches to about 0.045 inches.

In a different embodiment, the intermediate layer is a moisture barrier layer having a moisture vapor transmission rate less than the moisture vapor transmission rate of the outer cover layer.

Most golf balls consist of layers having different hardness, e.g. hardness gradients, to achieve desired performance characteristics. The present invention contemplates golf balls, having hardness gradients between layers, as well as those golf balls with layers having the same hardness.

For example, the cores of the present invention may have varying hardness depending on the particular golf ball construction. In one embodiment, the core hardness is at least about 15 Shore A, preferably about 30 Shore A, as measured on a formed sphere. In another embodiment, the core has a hardness of about 50 Shore A to about 90 Shore D. In yet another embodiment, the hardness of the core is about 80 Shore D or less. Preferably, the core has a hardness of about 30 to about 65 Shore D, and more preferably, the core has a hardness of about 35 to about 60 Shore D.

The intermediate layer(s) of the present invention may also vary in hardness, depending on the specific construction of the ball. In one embodiment, the hardness of the intermediate layer is about 30 Shore D or greater. In another embodiment, the hardness of the intermediate layer is about 90 Shore D or less, preferably about 80 Shore D or less, and more preferably about 70 Shore or less. In yet another embodiment, the hardness of the intermediate layer is about 50 Shore D or grater, preferably about 55 Shore D or greater. In one embodiment, the intermediate layer hardness is from about 55 Shore D to about 65 Shore D. The intermediate layer may also be about 65 Shore D or greater. The hardness of the intermediate layer and the cover layer is measured on a slab according to ASTM D-2240.

As with the core and intermediate layers, the cover hardness may vary depending on the construction and desired characteristics of the golf ball. The ratio of the cover hardness to inner ball hardness is a primary variable used to control the aerodynamics of a ball, and in particular, the spin of a ball. In general, the harder the inner ball, the greater is the driver spin; and the softer the cover, the greater is the drive spin.

For example, when the intermediate layer is intended to be the hardest point in the ball, e.g., about 50 Shore D to about 75 Shore D, the cover material may have a hardness of about 20 Shore D or greater, preferably about 25 Shore D or greater, and more preferably about 30 Shore D or greater, as measured on the slab. In another embodiment, the cover itself has a hardness of about 30 Shore D or greater. In particular, the cover may be from about 30 Shore D to about 70 Shore D. In one embodiment, the cover has a hardness of about 40 Shore D to about 65 Shore D, and in another embodiment, about 40 Shore to about 55 Shore D. In another aspect of the invention, the cover has a hardness less than about 45 Shore D, preferably less than about 40 Shore D, and more preferably about 25 Shore D to about 40 Shore D. In one embodiment, the cover has a hardness from about 30 Shore D to about 40 Shore D.

Compression values are dependent on the diameter of the component being measured. The Atti compression of the core, or portion of the core, of golf balls prepared according to the invention is preferably less than about 80, more preferably less than about 75. As used herein, the terms "Atti compression" or "compression" are defined as the deflection of an object or material relative to the deflection of a calibrated spring, as measured with an Atti Compression Gauge, that is commercially available from Atti Engineering Corp. of Union City, N.J. Atti compression is typically used to measure the compression of a golf ball. In another embodiment, the core compression is from about 40 to about 80, preferably from about 50 to about 70. In yet another embodiment, the core compression is preferably below about 50, and more preferably below about 25.

In an alternative, low compression embodiment, the core has a compression less than about 20, more preferably less than about 10, and most preferably, 0. As known to those of ordinary skill in the art, however, the cores generated according to the present invention may be below the measurement of the Atti Compression Gauge.

In one embodiment, golf balls of the invention preferably have an Atti compression of about 55 or greater, preferably from about 60 to about 120. In another embodiment, the Atti compression of the golf balls of the invention is at least about 40, preferably from about 50 to 120, and more preferably from about 60 to 100. In yet another embodiment, the compression of the golf balls of the invention is about 75 or greater and about 95 or less. For example, a preferred golf ball of the invention may have a compression from about 80 to about 95.

A different aspect of this invention relates to the use of the composition of blends of HNP's having acid group and DR existing in IPN formation for different types of sports equipment. The sports equipment includes other sport balls, golf club inserts, sport shoes and cleats.

The present invention is also directed to PW golf balls. The total weight of PW golf balls has to conform to the weight limit set by the United States Golf Association (USGA). Distributing the weight or mass of the ball either toward the center of the ball or toward the outer surface of the ball changes the dynamic characteristics of the ball at impact and in flight. Specifically, if the density is shifted or distributed toward the center of the ball, the moment of inertia is reduced, and the initial spin rate of the ball as it leaves the golf club would increase due to lower resistance from the ball's moment of inertia. Conversely, if the density is shifted or distributed toward the outer cover, the moment of inertia is increased, and the initial spin rate of the ball as it leaves the golf club would decrease due to the higher resistance from the ball's moment of inertia. The radial distance from the center of the ball or from the outer cover, where moment of inertia switches from being increased and to being decreased as a result of the redistribution of weight or mass density, is an important factor in golf ball design.

In accordance to one aspect of the PW golf ball, this radial distance, hereinafter referred to as the "centroid radius," is provided. When more of the ball's mass or weight is reallocated to the volume of the ball from the center to the centroid radius, the moment of inertia is decreased, thereby producing a high spin ball. When more of the ball's mass or weight is reallocated to the volume between the centroid radius and the outer cover, the moment of inertia is increased thereby producing a low spin ball.

Golf balls with PW characteristics provide better control of spin rate, which is an important feature for both skilled and recreational golfers. Golf balls with high spin rate allows the more skilled players to produce and control back spin to stop the ball on the green and side spin to draw or fade the ball. In contrast, recreational players prefer a low spin golf ball which tends not to drift off-line erratically if the shot is not hit squarely off the club face. As discussed above, the control of the spin rate of golf balls can be achieved by using the appropriate PW golf balls that match the skill level of the golf players.

When the weight of a PW golf ball is allocated to the outside of the centroid radius, i.e., the density of the ball inside the centroid radius is less than 1.0, the moment of inertia is increased relative to the baseline moment of inertia. When the weight of the PW golf ball is allocated to the inside of the centroid radius, i.e., the density of the ball inside the centroid radius is greater than 1.0, the moment of inertia is decreased.

In one embodiment of this invention, a PW golf ball comprises an inner core, at least two intermediate mantles and a solid cover. In a different embodiment of this invention, a PW golf ball comprises an inner core that takes up a more than half of the volume of the ball, at least one intermediate mantle and a solid cover. In another embodiment of this invention, a PW golf ball comprises an inner core that takes up most of the volume of the ball, a relatively thin mantle and a cover. Further details of the controlling of spin rate may be found in commonly owned U.S. Pat. No. 6,494,795 to Sullivan, which is incorporated by reference in its entirety.

In one embodiment of this invention, the PW golf balls comprising a thin dense layer encasing a core, and the thin dense layer is encased by a cover, wherein at least one of the thin dense layer, the core and the cover comprises a blend of an HNP formed from an ionomer containing an acid group, a cation source, and a salt of an organic acid, and a DR. The cation source is present in sufficient amounts so that the HNP is neutralized by at least 80%. The highly neutralized polymer and the diene rubber may form an interpenetrable network.

In one embodiment of the PW golf balls, the HNP and DR are in IPN formation. In another embodiment of the PW golf balls, the HNP in the IPN is in a continuous phase. In a different embodiment of the PW golf balls, the DR in the IPN is in a continuous phase. In another embodiment of this invention, both the HNP and the DR in the IPN are in continuous phases. The different embodiments having at least one of HNP and DR to be in a continuous phase exhibit different properties from those embodiments in which neither HNP nor DR are in a continuous phase.

In a different embodiment of the PW golf balls, the HNP and the DR are not in an IPN formation. As a result, this embodiment exhibits different properties from those embodiments in which the HNP and the DR are in IPN.

In a different embodiment of the present invention, the PW golf ball comprises a thin dense layer encasing a core and the thin dense layer is encased by a cover, wherein the thin dense layer has an inner diameter of at least 38.4 mm and a specific gravity of greater than 1.2 and a thickness from about 0.025 mm to 1.27 mm, and the thin dense layer is positioned at a radial distance outside of the centroid radius, and wherein the core comprises a core layer comprising an elastomeric composition, less than about 10 per of a reactive co-agent and a cross-linking agent. Preferably the core layer comprises less than about 5 per of the reactive co-agent and more preferably about 0 per of the reactive co-agent.

In one embodiment, the core of the PW golf ball comprises at least a layer of elastomer, such as a DP, that is cross-linked with low levels of a reactive co-agent, such as metal salt of diacrylate, dimethacrylate or monomethacrylate, preferably zinc diacrylate (ZDA), or alternatively with no reactive co-agent. Suitable metal salts include zinc, magnesium, calcium, barium, tin, aluminum, lithium, sodium, potassium, iron, zirconium, and bismuth, among others. Preferably, the elastomer is cross-linked with a cross-linking initiator, such as peroxide or sulfur.

Other suitable embodiments of the PW golf balls may be found in commonly owned co-pending parent U.S. patent application Publication No. 2003/0022733 by Sullivan et al., which is incorporated by reference in its entirety. The '733 publication relates to a PW golf ball wherein the core comprises a DR that has low or no cross-link density with a reactive co-agent. The '733 publication also teaches a thin dense layer comprising a DR cross-linked with a reactive co-agent such as a metal salt of diacrylate, and dimethacrylate.

Other than in the operating examples, or unless otherwise expressly specified, all of the numerical ranges, amounts, values and percentages such as those for amounts of materials, times and temperatures of reaction, ratios of amounts, values for molecular weight (whether number average molecular weight ($M_n$) or weight average molecular weight ($M_w$), and others in the following portion of the specification may be read as if prefaced by the word "about" even though the term "about" may not expressly appear with the value, amount or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Therefore, it will be understood that the appended claims are intended to cover all such modifications and embodiments, which would come within the spirit and scope of the present invention.

What is claimed is:

1. A golf ball a core and a cover, wherein at least one of the core or the cover comprises a blend of:

a highly neutralized jonomer formed from a reaction between an jonomer having acid groups, a suitable cation source, and a salt of an organic acid, the cation source being present in an amount sufficient to neutralized the acid by 80% or greater; and a crosslinked or vulcanized diene rubber blend comprising:

a first polybutadiene formed with a cobalt or nickel catalyst having a first Mooney viscosity between 40 to 150; and a second polybutadiene formed with a lanthanide series catalyst having a second Mooney viscosity between 30 to 100, wherein the first Mooney viscosity is greater than the second Mooney viscosity, and wherein the blend has a greater weight percentage of the first polybutadiene than that of the second polybutadiene.

2. The golf ball of claim 1, wherein the highly neutralized ionomer and the diene rubber form a dynamically vulcanized alloy.

3. The golf ball of claim 1, wherein the highly neutralized ionomer and the diene rubber form an interpenetrating polymer network.

4. The golf ball of claim 3, wherein at least one of the highly neutralized ionomer or diene rubber is in a continuous phase in the interpenetrating polymer network.

5. The golf ball of claim 3, wherein the highly neutralized ionomer and the diene rubber are in co-continuous phases in the interpenetrating polymer network.

6. The golf ball of claim 1, wherein the core or the cover further comprises ionomeric copolymers, ionomeric terpolymers, ionomer precursors, thermoplastics, thermoplastic elastomers, grafted metallocene-catalyzed polymers, non-grafted metallocene-catalyzed polymers, single-site polymers, high-crystalline acid polymers and ionomers thereof, or cationic ionomers.

7. The golf ball of claim 1, wherein the organic acid is selected from the group consisting of aliphatic organic acids, aromatic organic acids, saturated mono-, di or multi-functional organic acids, unsaturated mono-, di- or multi-functional organic acids, and multi-unsaturated mono-functional organic acids.

8. The golf ball of claim 1, wherein the cation source comprises barium, lithium, sodium, zinc, bismuth, chromium, cobalt, copper, potassium, strontium, titanium, tungsten, magnesium, cesium, iron, nickel, silver, aluminum, tin, or calcium.

9. The golf ball of claim 1, wherein the highly neutralized ionomer is neutralized by 90% or greater.

10. The golf ball of claim 1, wherein the highly neutralized jonomer is neutralized 100%.

11. The golf ball of claim 1, wherein the sulfur-cured diene rubber is a product of treating a diene rubber with a vulcanizing agent comprising sulfur; insoluble sulfur; 4-morpholinyl-2-benzothiazole disulfide; dipentamethylenethiuram hexasulfide; thiuram disulfides; N-oxydiethylene 2-benzothiazole sulfonamide; N,N-diorthotolyguanidine; bismuth dimethyldithiocarbamate; N-cyclohexyl 2-benzothiazole sulfonamide; or N,N-diphenylguanidine.

12. The golf ball of claim 1, wherein the peroxide-cured diene rubber is a product of treating a diene rubber with an initiating agent comprising dicumyl peroxide; 2,5-dimethyl-2,5-di(t-butylperoxy) hexane; 2,5-dimethyl-2,5-di(t-butylperoxy) hexyne; 2,5-dimethyl-2,5-di(benzoylperoxy) hexane; 2,2'-bis(t-butylperoxy)-di-iso-propylbenzene; 1,1-bis (t-butylperoxy)-3,3,5-trimethyl cyclohexane; n-butyl 4,4-bis(t-butyl-peroxy) valerate; t-butyl perbenzoate; benzoyl peroxide; n-butyl 4,4'-bis(butylperoxy) valerate; di-t-butyl peroxide; or 2,5-di-(t-butylperoxy)-2,5 dimethyl hexane.

13. The golf ball of claim 1, wherein the core has a diameter from 1.25 inches to 1.65 inches.

14. The golf ball of claim 1, wherein the core has a hardness of 50 Shore A to 90 Shore D.

15. The golf ball of claim 1, wherein the core comprises an inner core layer having a diameter of 0.25 inches to 1.6 inches and an outer core layer having a thickness of 0.1 inches or greater.

16. The golf ball of claim 1, wherein the golf ball further comprises an intermediate layer having a thickness of 0.002 inches to 0.1 inches.

17. The golf ball of claim 16, wherein the intermediate layer has a thickness of 0.01 inches to 0.045 inches.

18. The golf ball of claim 16, wherein the intermediate layer is a moisture barrier layer, and wherein the moisture vapor transmission rate of the intermediate layer is less than the moisture vapor transmission rate of the cover layer.

19. The golf ball of claim 16, wherein the intermediate layer has a hardness of 30 Shore D or greater.

20. A golf ball comprising:

a core, a cover, and a thin dense layer disposed between the core and the cover, the thin dense layer having a specific gravity of greater than 1.2 and being located outside of a centroid radius of the ball, wherein at least one of the core, the thin dense layer, or the cover comprises a blend of a highly neutralized ionomer formed from a reaction between an ionomer having acid groups, a suitable cation source, and a salt of an organic acid, the cation source being present in an amount sufficient to neutralized the acid by 80% or greater; and a diene rubber blend comprising:

a first polybutadiene formed with a cobalt or nickel catalyst having a first Mooney viscosity between 40 to 150; and a second polybutadiene formed with a lanthanide series catalyst having a second Mooney viscosity between 30 to 100, wherein the first Mooney viscosity is greater than the second Mooney viscosity, and wherein the blend has a greater weight percentage of the first polybutadiene than that of the second polybutadiene.

21. The golf ball of claim 20, wherein the highly neutralized ionomer is neutralized by at least 90%.

22. The golf ball of claim 20, wherein the highly neutralized ionomer is neutralized 100%.

23. The golf ball of claim 20, wherein the sulfur-cured diene rubber is a product of treating a diene rubber with a vulcanizing agent comprising sulfur; insoluble sulfur; 4-morpholinyl-2-benzothiazole disulfide; dipentamethylenethiuram hexasulfide; thiuram disulfides; N-oxydiethylene 2-benzothiazole sulfonamide; N,N-diorthotolyguanidine; bismuth dimethyldithiocarbamate; N-cyclohexyl 2-benzothiazole sulfonamide; or N,N-diphenylguanidine.

24. The golf ball of claim 20, wherein the peroxide-cured diene rubber is a product of treating a diene rubber with an initiating agent comprising dicumyl peroxide; 2,5-dimethyl-2,5-di(t-butylperoxy) hexane; 2,5-dimethyl-2,5-di(t-butylperoxy) hexyne; 2,5-dimethyl-2,5-di(benzoylperoxy) hexane; 2,2'-bis(t-butylperoxy)-di-iso-propylbenzene; 1,1-bis(t-butylperoxy)-3,3,5-trimethyl cyclohexane; n-butyl 4,4-bis(t-butyl-peroxy) valerate; t-butyl perbenzoate; benzoyl peroxide; n-butyl 4,4'-bis(butylperoxy) valerate; di-t-butyl peroxide; or 2,5-di-(t-butylperoxy)- 2,5 dimethyl hexane.

25. The golf ball of claim 20, wherein the highly neutralized ionomer and the diene rubber form a dynamically vulcanized alloy.

26. The golf ball of claim 20, wherein the highly neutralized ionomer and the diene rubber form an interpenetrating polymer network.

27. A one-piece golf ball comprising a blend of:

a highly neutralized ionomer formed from a reaction between an ionomer having acid groups, a suitable cation source, and a salt of an organic acid, the cation source being present in an amount sufficient to neutralized the acid by 80% or greater; and a crosslinked or vulcanized diene rubber.

* * * * *